US007444963B2

(12) United States Patent
Tanaka

(10) Patent No.: US 7,444,963 B2
(45) Date of Patent: Nov. 4, 2008

(54) COMBUSTION POWER TOOL

(75) Inventor: Katsutoshi Tanaka, Anjo (JP)

(73) Assignee: Makita Corporation, Anjo-Shi, Aichi-Ken (JP)

( * ) Notice: Subject to any disclaimer, the term of this patent is extended or adjusted under 35 U.S.C. 154(b) by 0 days.

(21) Appl. No.: 11/777,708

(22) Filed: Jul. 13, 2007

(65) Prior Publication Data

US 2008/0011251 A1 Jan. 17, 2008

(30) Foreign Application Priority Data

Jul. 14, 2006 (JP) ..... 2006-194197

(51) Int. Cl.
*F02B 71/00* (2006.01)

(52) U.S. Cl. ..... 123/46 SC; 227/10

(58) Field of Classification Search ..... 123/46 SC; 227/10

See application file for complete search history.

(56) References Cited

U.S. PATENT DOCUMENTS

2006/0042574 A1 3/2006 Tomomasa
2006/0065690 A1 3/2006 Haruhisa

FOREIGN PATENT DOCUMENTS

EP 0 642 892 A1 3/1995
JP 02262953 A 10/1990

OTHER PUBLICATIONS

Search Report from European Patent Office, Oct. 19, 2007.

*Primary Examiner*—Noah Kamen
(74) *Attorney, Agent, or Firm*—Orrick, Herrington & Sutcliffe LLP

(57) ABSTRACT

It is an object of the invention to provide a reliable ignition by a spark plug in a combustion power tool. Representative combustion power tool may comprise a combustion chamber, a gas supply section, a single spark plug, an ignition control device, a cylinder connected to the combustion chamber, a piston member and a tool member. The ignition control device includes a plurality of ignition circuits connected to the single spark plug to independently input power to the spark plug, and a control section that controls the manner of power input in each of the ignition circuits. According to such construction, power input in each of the ignition circuits can be controlled and therefore, a desired power output at the single spark plug can be realized.

10 Claims, 15 Drawing Sheets

COMBUSTION POWER TOOL

BACKGROUND OF THE INVENTION

1. Field of the Invention

The present invention relates to a combustion power tool that performs a predetermined operation by utilizing a combustion pressure generated upon combustion of flammable gas in a combustion chamber.

2. Description of the Related Art

Japanese non-examined laid-open Patent Publication No. 2006-95638 discloses a combustion nailing machine that explosively burns a mixture of flammable gas and air by ignition of a spark plug and thereby performs a nail driving operation. This nailing machine includes an ignition control device having a single capacitor-type ignition circuit connected to a single spark plug. The ignition control device controls to generate multiple consecutive sparks of the capacitor-type ignition circuit.

According to the above-mentioned prior art, it may be possible to prevent flameout of sparks by generating multiple consecutive sparks. However, single capacitor-type ignition circuit is connected to the single spark plug and therefore, subsequent sparking cannot be performed until the charging capacitor in the ignition circuit is charged. Thus, if the gas concentration in the mixture varies, ignition may not be effected at all or effected after a considerable number of times of sparks.

SUMMARY OF THE INVENTION

Accordingly, it is an object of the invention to provide a reliable ignition by a spark plug in a combustion power tool.

The above-described object can be achieved by a claimed invention. According to the invention, a representative combustion power tool performs a predetermined operation by utilizing a combustion pressure generated upon combustion of flammable gas in a combustion chamber. The combustion power tool includes at least a combustion chamber, a gas supply section, a single spark plug, an ignition control device, a cylinder, a piston member and a tool member.

The gas supply section serves to supply flammable gas into the combustion chamber. Typically, the gas supply section may be defined by a gas cylinder filled with flammable gas, a connection path that connects the gas cylinder to the combustion chamber, a jet through which flammable gas is injected into the combustion chamber, etc.

The single spark plug is disposed within the combustion chamber and serves to output electric power supplied from a power supply and thereby burn the flammable gas within the combustion chamber. The ignition control device controls power to be outputted at the single spark plug.

The cylinder is disposed adjacent to the combustion chamber, and the piston member is slidably disposed within the cylinder. The piston member can slide within the cylinder by combustion pressure which is generated by combustion of the flammable gas in the combustion chamber. Further, the tool member is actuated by sliding movement of the piston member and applies an impact force to a workpiece, thereby performing a predetermined operation. Specifically, in the combustion power tool according to this invention, electric power controlled by the control section is outputted from the single spark plug. Thus, the flammable gas is burned within the combustion chamber and a predetermined operation is performed by utilizing a combustion pressure generated by this gas combustion.

The representative combustion power tool is provided with an ignition control device. The ignition control device includes a plurality of ignition circuits that are connected to the single spark plug and can independently input power to the spark plug, and a control section that controls the manner of power input in each of the ignition circuits. The ignition circuits of the ignition control device may comprise a capacitor-type ignition circuit and/or a transistor-type ignition circuit. The "manner of power input" in each of the ignition circuits here includes various input manners of power to be inputted to the single spark plug, such as the time, timing, intensity and other factors of power input in each of the ignition circuits as well as the number of ignition circuits which contribute to power input.

Further, the control section may control the manner of power input so as to change the manner of power output in each of the ignition circuits. In this case, the "manner of power output" at the single spark plug may include various output manners of power to be outputted from the spark plug, such as the time, timing, intensity and other factors of power output at the single spark plug.

According to the invention, the number of the ignition circuits to be used, the discharge timing (spark timing) in each of the ignition circuits, the discharge waveform in each of the ignition circuits, or other factors may be changed based on the results of detection, for example, of the battery voltage, temperature relating to the combustion chamber, and the spark current at the time of plug ignition. Thus, power input in each of the ignition circuits can be controlled. Therefore, a desired power output at the single spark plug can be realized and reliable ignition can be realized by the spark plug with a reduced number of times of ignition.

As another aspect of the invention, the combustion power tool may preferably include a voltage detecting section for detecting voltage of the power supply. Based on the voltage of the power supply, when the detected voltage is below a predetermined voltage threshold, the control section may input power to the single spark plug via a smaller number of ignition circuits than when the detected voltage exceeds the voltage threshold. With this construction, when the voltage of the power supply is relatively low, the number of the ignition circuits to be used is reduced so that reliable plug ignition of the single spark plug can be realized.

Further, as another aspect of the invention, the combustion power tool may preferably include a temperature detecting section for detecting temperature relating to the combustion chamber. The control section may determine a next power input timing in each of the ignition circuits based on the temperature relating to the combustion chamber. The temperature relating to the combustion chamber may be defined by a temperature or other index that reflects the temperature of the combustion chamber. As these temperatures, the surface temperature of the cylinder connected to the combustion chamber and the outside air temperature around the power tool as well as the temperature of the combustion chamber may be utilized. With such construction, for example when the temperature of the combustion chamber is relatively low, a next power input timing may be controlled to be advanced in order to secure a reliable plug ignition.

Further, another aspect of the combustion power tool may include a current detecting section for detecting spark current at the time of plug ignition of the single spark plug and a warning output section for outputting a warning to a user. The control section may transmit a warning output signal to the warning output section when the spark currently detected by the current detecting section at the time of the plug ignition of the single spark plug is below a predetermined current threshold. In the warning output section, a voice output, a display output or other warning output may preferably be utilized. With such construction, warning can be given in response to the spark current at the time of plug ignition of the single spark plug. Specifically, when the spark current at the time of plug ignition of the single spark plug is relatively low, the warning output section can warn the user of the low spark current.

Further, another aspect of the combustion power tool may include an information detecting section for detecting at least one of pressure information relating to the combustion pressure within the combustion chamber and positional information relating to the actuated position of the tool member. The control section determines completion of combustion within the combustion chamber based on the information detected by the information detecting section.

With such construction, by determining completion of combustion within the combustion chamber, the plug ignition operation of the spark plug is repeated when the combustion has not been properly completed so that combustion can be more reliably performed. As a result, a feedback control can be performed in response to the combustion status within the combustion chamber.

Plurality of the ignition circuits may comprise at least two capacitor-type ignition circuits. Otherwise, plurality of the ignition circuits of the ignition control device may comprise a capacitor-type ignition circuit and a transistor-type ignition circuit. Or other alternative, plurality of the ignition circuits may comprise at least two transistor-type ignition circuits.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved combustion power tools and method for using such combustion power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A representative embodiment of the combustion power tool according to the invention will now be described with reference to the drawings. Representative nailing machine 101 performs an operation of driving nails into a workpiece by utilizing a combustion pressure generated upon combustion of flammable gas in a combustion chamber. In the description hereinafter, the side of a nail ejection part 110 (the left side as viewed in FIG. 1) in the nailing machine 101 will be taken as the front side, and the opposite side (the right side as viewed in FIG. 1) as the rear side.

Figure 1:
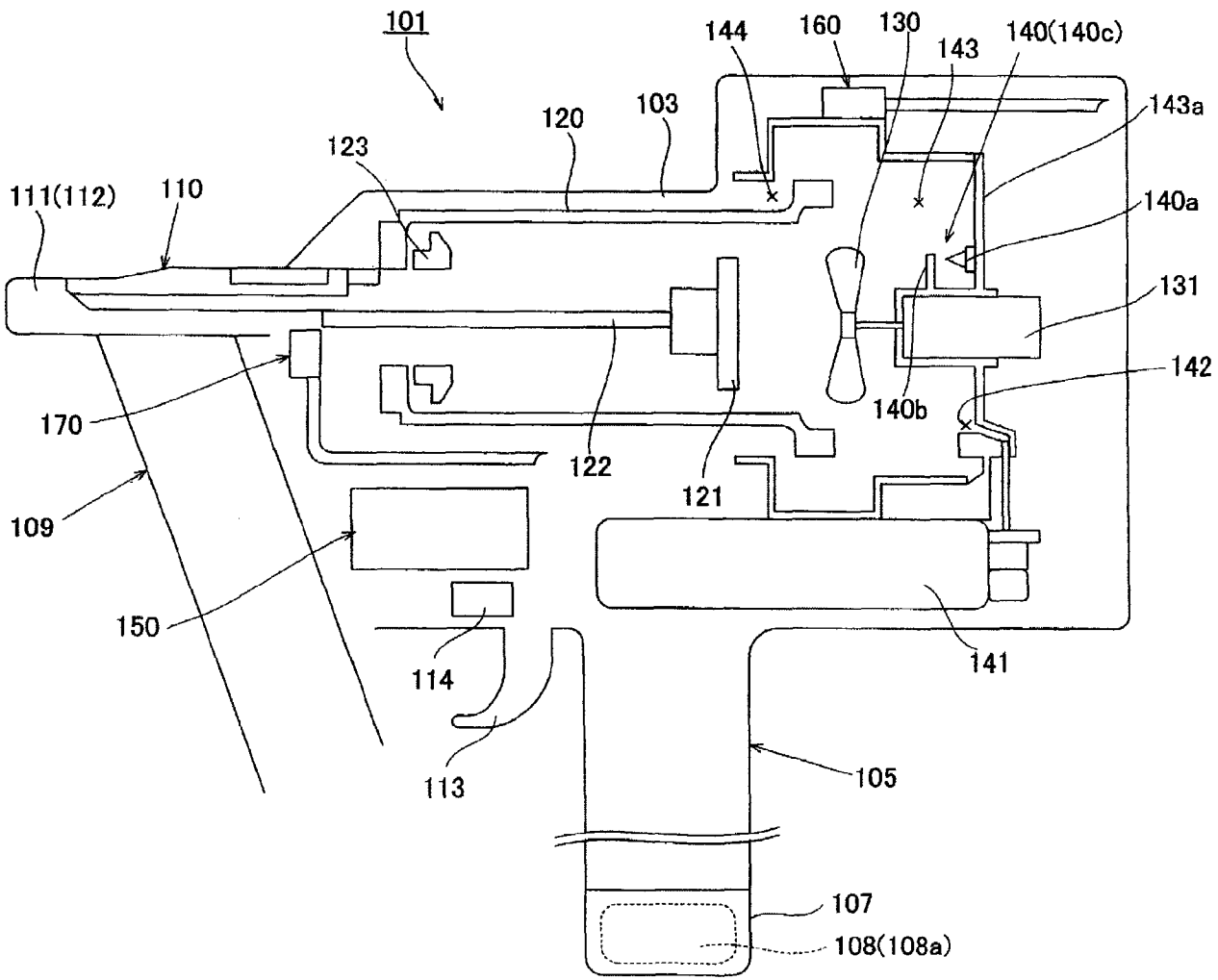
FIG. 1 is a schematic view showing the entire construction of a nailing machine 101 according to the representative embodiment, with a piston shown located in its initial position.

FIG. 1 is a schematic view showing the entire construction of the nailing machine 101 with a piston shown located in its initial position.

As shown in FIG. 1, the representative nailing machine 101 comprises a housing 103, a handgrip 105, a magazine 109, a nail ejection part 110 and a trigger 113. The housing 103 houses a cylinder 120, a piston 121, a driver 122 integrally formed with the piston 121, a cushion rubber 123, a fan 130, a motor 131, a spark plug 140, a gas cylinder 141, a jet 142, a combustion chamber 143, an exhaust port 144, an ignition control device 150, an impact sensor 160 and a photoelectric switch 170.

The handgrip 105 has a grip part which is held by a user during operation of the nailing machine 101. A holder 107 is attached to the lower end of the handgrip 105 and houses a battery 108. The battery 108 is provided with a voltage detecting circuit **108*a*. The voltage detecting circuit 108*a* is a feature that corresponds to the "voltage detecting section" according to this invention. Further, the trigger 113 is disposed forward of the handgrip 105 such that the user can depress the trigger 113 while holding the grip part of the handgrip 105. A trigger switch 114 is actuated by the depressing operation of the trigger 113, which effects ignition of the spark plug 140** which will be described below in detail.

The magazine 109 is mounted to the nail ejection part 110 formed on the front end of the housing 103 of the nailing machine 101, The magazine 109 contains numerous nails N connected with each other and places a nail N to be driven next, into the ejection part 110. The construction of the magazine 109 itself is well-known and thus will not be explained in further detail. A contact arm 111 is mounted on the front end of the ejection part 110. The contact arm 111 can slide with respect to the ejection part 110 in the longitudinal direction of the ejection part 110 (the longitudinal direction of the nailing machine 101) and is normally biased to the front end side (forward) by a biasing means in the form of a spring (not shown). Further, a contact arm switch 112 is provided for detecting the contact arm 111 pressed against the workpiece against the biasing force of the spring.

The cylinder 120 comprises a piston accommodating part that communicates with the combustion chamber 143 and extends in the longitudinal direction of the power tool. The cylinder 120 is a feature that corresponds to the "cylinder" according to this invention. The piston 121 is disposed within the cylinder 120 and can slide in the longitudinal direction of the power tool within the cylinder 120 by combustion pressure of the combustion chamber 143. The piston 121 is a feature that corresponds to the "piston member" according to this invention. A cushion rubber (or bumper) 123 is disposed in the front region of the cylinder 120. When the piston 121 is driven at high speed and abruptly moves to the front region of the cylinder 120, the cushion rubber 123 serves to absorb and alleviate the impact of the piston 121 and receive the piston 121, thereby absorbing excess energy of the piston 121. The driver 122 is actuated by sliding movement of the piston 121 and comprises a member for performing the operation of driving nails into the workpiece. The driver 122 is a feature that corresponds to the "tool member" according to this invention.

The combustion chamber 143 is a combustion space in which a mixture of flammable gas and air is burned and which is designed as a space defined by a combustion chamber wall 143*a*, the cylinder 120 and the piston 121. The combustion chamber 143 is a feature that corresponds to the "combustion chamber" according to this invention. The fan 130 that is rotationally driven by the motor 131 and the single spark plug 140 that generates a spark between electrodes when the trigger 113 is depressed are disposed within the combustion chamber 143.

The gas cylinder 141 serves to store a predetermined flammable gas (liquefied gas). The gas cylinder 141 communicates with the combustion chamber 143 via a gas supply path, and the flammable gas filled in the gas cylinder 141 is supplied to the combustion chamber 143 through the jet 142 which is located downstream in the gas supply path. The gas cylinder 141 and the jet 142 form the "gas supply section" according to this invention.

During supply of the flammable gas, the fan 130 is rotationally driven by the motor 131 and stirs the flammable gas supplied into the combustion chamber 143 through the jet 142. The fan 130 thus serves to even up the concentration of the flammable gas within the combustion chamber 143. Further, the flammable gas burned in the combustion chamber 143 is discharged out of the combustion chamber 143 through the exhaust port 144. During the gas discharge, the fan 130 is rotationally driven by the motor 131 and serves to quickly discharge the burned gas out of the combustion chamber 143 through the exhaust port 144, The spark plug 140 is disposed within the combustion chamber 143 and serves to output electric power supplied from the battery 108 and thereby burn the flammable gas within the combustion chamber 143 in the state in which the flammable gas is supplied from the gas cylinder 141 into the combustion chamber 143 through the jet 142. The spark plug 140 is a feature that corresponds to the "single spark plug" according to this invention. The spark plug 140 mainly includes two electrodes 140*a*, 140*b* of which respective ignition parts are opposed to each other. The one electrode 140*a* forms a central electrode and the other electrode 140*b* forms an earthed electrode. Further, the spark plug 140 has a temperature detecting circuit 140*c* for detecting temperature relating to the combustion chamber 143 (the temperature of the combustion chamber 143 or the surface temperature of the cylinder 120). The temperature detecting circuit 140*c* is a feature that corresponds to the "temperature detecting section" according to this invention.

The ignition control device 150 serves to control the electric power outputted between the electrodes of the spark plug 140. The ignition control device 150 is a feature that corresponds to the "ignition control device" according to this invention. The ignition control device 150 is electrically connected to an object to transmit a control signal, such as the trigger switch 114, and transmits control signals. Specifically, the ignition control device 150 includes an ignition circuit unit (an ignition circuit unit 210, 220 or 230 which will be described below) and a microcomputer (or a controller) 151 electrically connected to the ignition circuit units. The microcomputer 151 executes charge control of charging capacitors C1, C2 of ignition circuits 1, 2 which will be described below and spark control of the spark plug 140 as well as start-up control and rotation control of the motor 131. The microcomputer 151 is a feature that corresponds to the "control section" according to this invention. Further, the ignition control device 150 is electrically connected to the battery 108 disposed within the holder 107 and thus receives power from the battery 108.

The impact sensor 160 is designed as a sensor for detecting combustion pressure in the vicinity of the combustion chamber 143 when the spark plug 140 sparks. The photoelectric switch 170 is designed as a sensor for detecting the position of the driver 122.

FIGS. 2 to 13 are referred to with regard to specific construction and operation of the ignition circuits according to the ignition control device 150.

Figure 2:
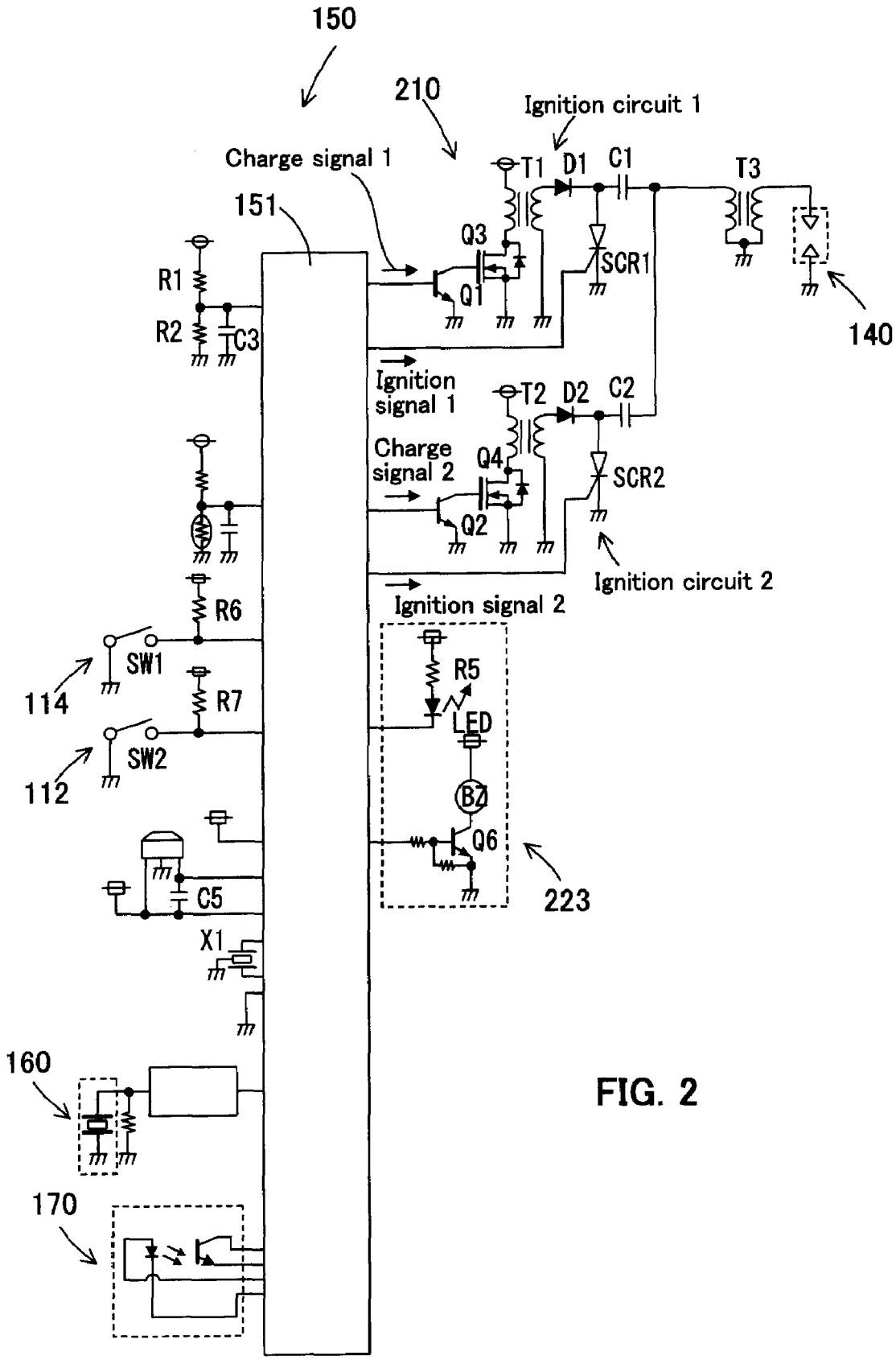
FIG. 2 is a schematic diagram showing a first embodiment of an ignition circuit unit 210 in the ignition control device 150.

FIG. 2 is a schematic diagram showing a first embodiment of the ignition circuit unit 210 in the ignition control device 150 of the present embodiment. As shown in FIG. 2, the ignition circuit unit 210 is featured by the construction having a combination of the "capacitor-type" ignition circuits 1, 2. Specifically, the ignition circuit unit 210 includes the charging capacitors C1, C2 and trigger elements SCR1, SCR2 for discharging the charging capacitors C1, C2, on the primary side of the ignition coil. The capacitor-type ignition circuits 1, 2 are features that correspond to the "plurality of ignition circuits" according to this invention. Charge in the charging capacitor C1 of the ignition circuit 1 is executed based on a charge signal 1 from the microcomputer 151 and discharge in the charged charging capacitor C1 is executed based on an ignition signal 1 from the microcomputer 151. Likewise, charge in the charging capacitor C2 of the ignition circuit 2 is executed based on a charge signal 2 from the microcomputer 151, and discharge in the charged charging capacitor C2 is executed based on an ignition signal 2 from the microcomputer 151. Thus, the timing of charge and discharge in each of the charging capacitors C1 and C2 can be individually controlled by the microcomputer 151.

Further, in the ignition circuit unit 210, the combustion pressure within the combustion chamber 143 and the behavior of the driver 122 or other elements are electrically detected by the impact sensor 160 and the photoelectric switch 170. The microcomputer 151 determines, based on the detected information, whether combustion has been properly completed. When the microcomputer 151 determines that combustion of flammable gas in the combustion chamber 143 has been properly completed, the ignition circuit unit 210 is immediately shut down. The impact sensor 160 and the photoelectric switch 170 form the "information detecting section" according to this invention which detects pressure information relating to the combustion pressure within the combustion chamber 143 and positional information relating to the actuated position of the driver 122. It may be constructed such that detection of completion of combustion may be determined based on the information detected only by either one of the impact sensor 160 and the photoelectric switch 170.

Besides the impact sensor 160 and the photoelectric switch 170, an ultrasonic sensor for detecting the travel of the driver during operation of driving nails, or a sensor for detecting driving noise caused during operation of driving nails, by using a piezoelectric element or other similar elements, may be used as a means for electrically detecting the combustion pressure within the combustion chamber 143 and the behavior of the driver 122 or other elements.

Figure 3:
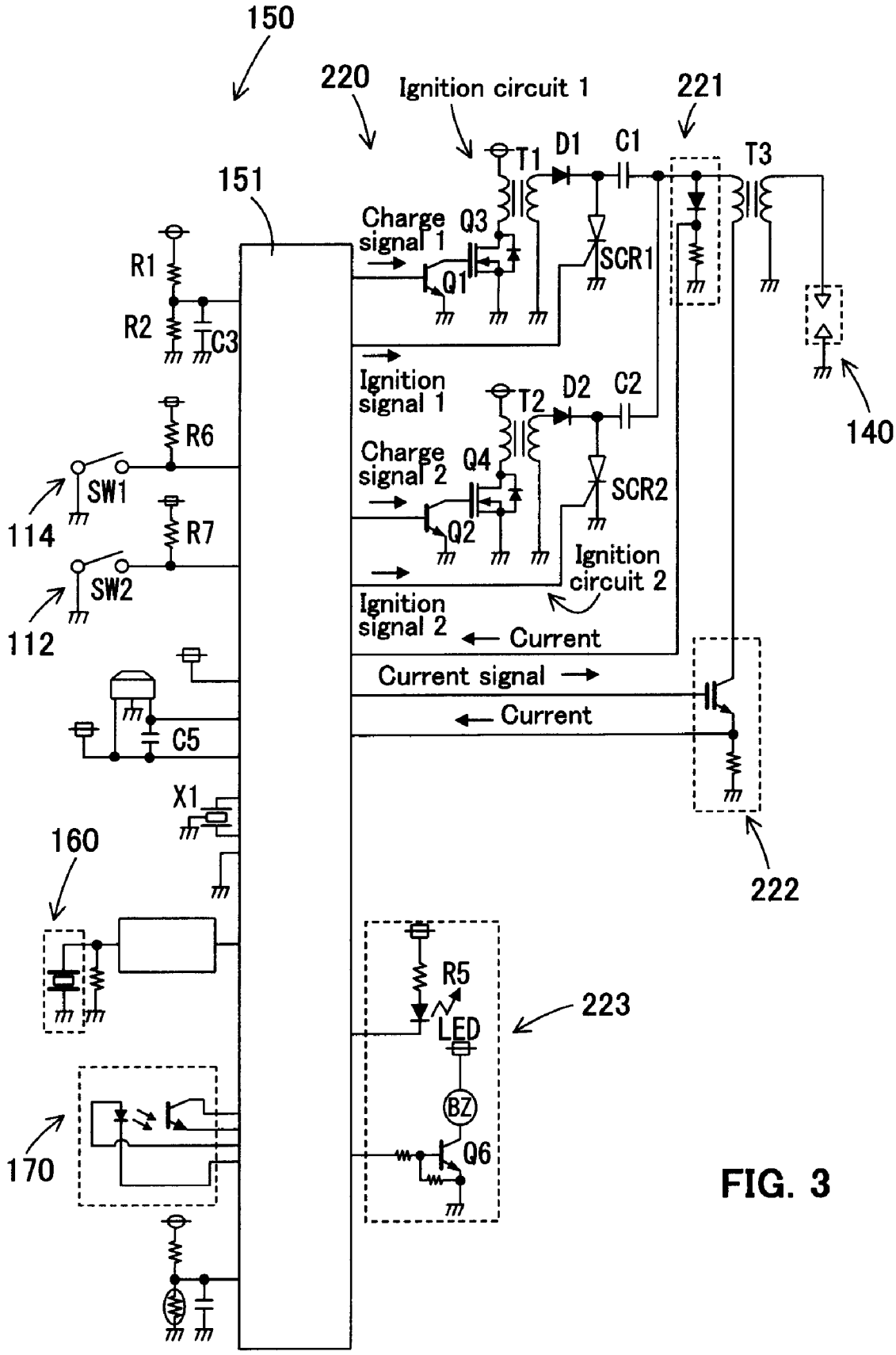
FIG. 3 is a schematic diagram showing a second embodiment of an ignition circuit unit 220 in the ignition control device 150.

FIG. 3 is a schematic diagram showing a second embodiment of the ignition circuit unit 220 in the ignition control device 150 of the present embodiment. As shown in FIG. 3, like the ignition circuit unit 210, the ignition circuit unit 220 has a construction having a combination of the "capacitor type" ignition circuits 1, 2 and further includes current detecting circuits 221, 222.

The current detecting circuit 221 is disposed in parallel with the charging capacitors C1, C2 and serves to continuously or intermittently detect a spark current and compare the detected current value with a previously stored current value each time, thereby detecting any abnormal condition of the charging capacitors C1, C2. The current detecting circuit 221 is disposed on the ignition coil and serves to detect a short circuit of the ignition coil. The charging capacitors C1, C2 form the "current detecting section for detecting spark current at the time of plug ignition of the single spark plug" according to this invention. At this time, based on the information detected by the current detecting circuits 221, 222, the microcomputer 151 determines whether the circuits are normal or abnormal. When the microcomputer 151 determines that the circuits are abnormal, the user is warned of the fact by shutdown of power supply to the ignition circuit unit 220 or by an LED (display output) or a beeper (voice output) of a warning device (warning circuit) 223. This warning device 223 is a feature that corresponds to the "warning output section for outputting a warning to a user" according to this invention. This arrangement can prevent breakage on the microcomputer 151 side which may be caused by a short circuit of the ignition coil, and smoking which may be caused by a short circuit of the power source, and thus can ensure safety. When only either one of the charging capacitors C1, C2 is faulty, only a warning of the failure is given and the circuits can continue to operate as ordinary capacitor-type ignition circuits. The current detecting circuits 221, 222 may be formed by a combination of a diode and a resistance.

Figure 4:
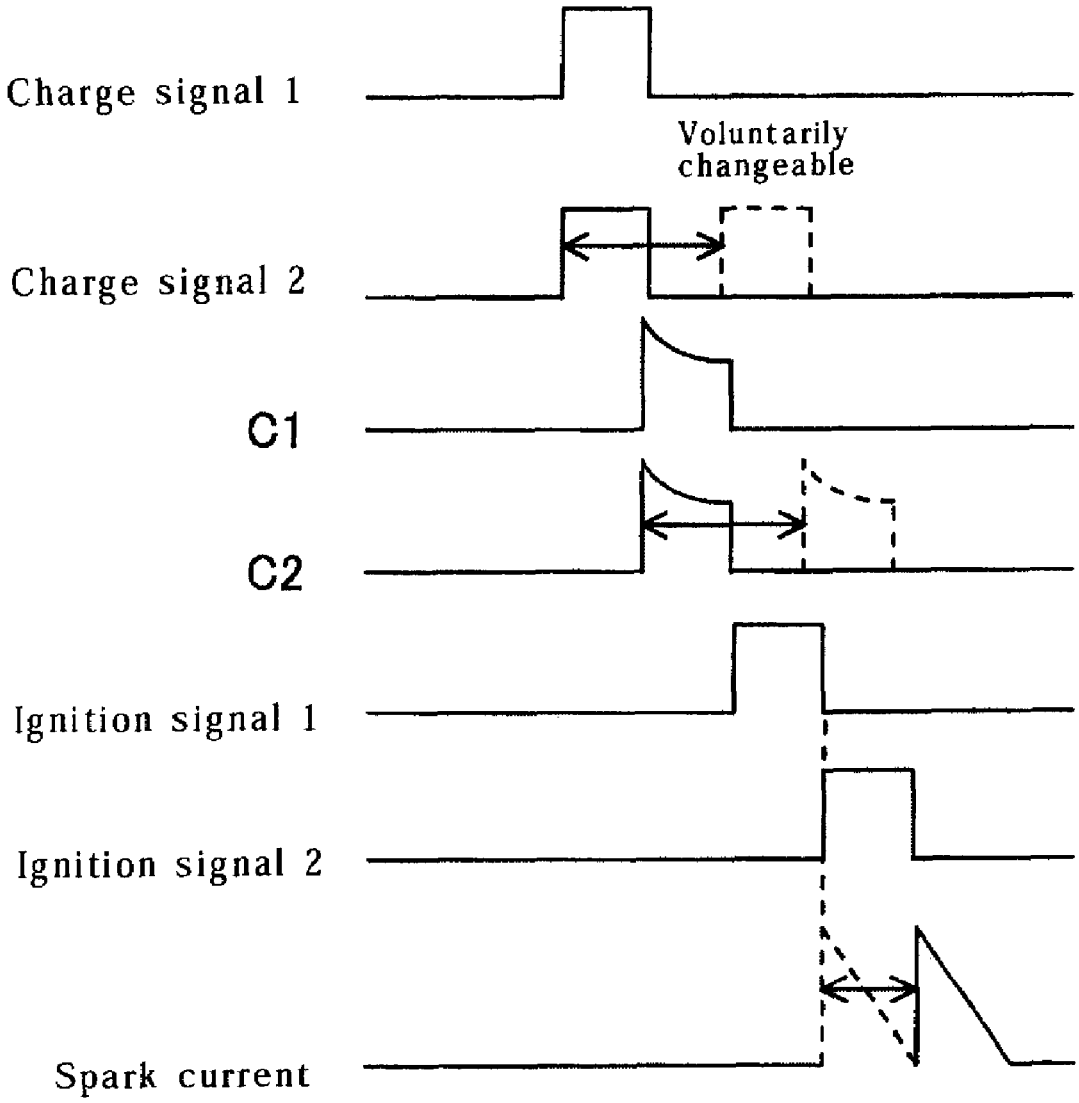
FIG. 4 is an operation time chart of the ignition circuit in the ignition circuit unit 210.
Figure 5:
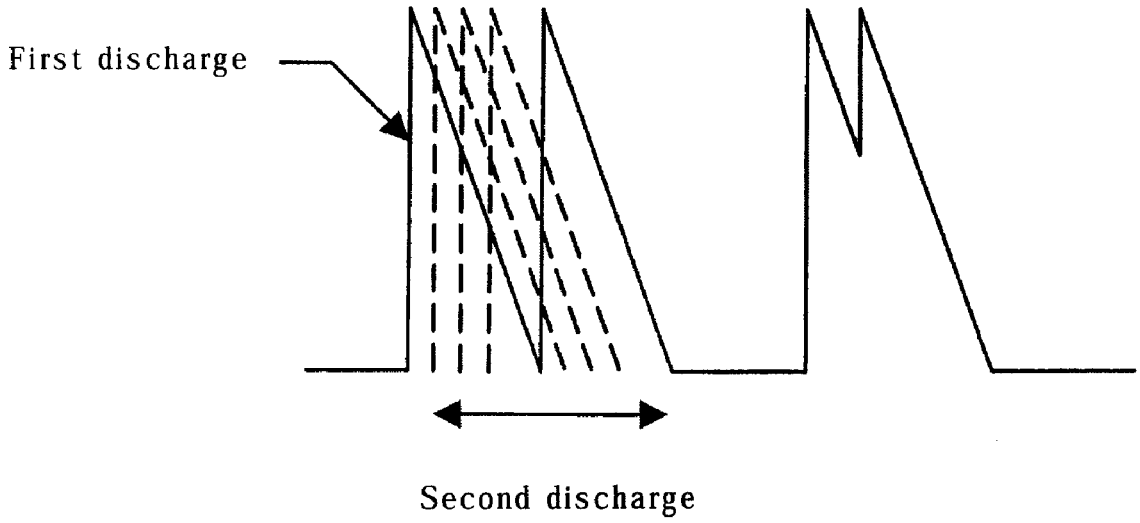
FIG. 5 shows a discharge waveform in the ignition circuit unit 210.

FIGS. 4 and 5 as well as FIG. 2 are referred to with regard to the timing of actuation of the ignition circuit unit 210 in the above-described ignition control device 150. FIG. 4 is an operation time chart of the ignition circuit. FIG. 5 shows a discharge wave form in the ignition circuit unit 210.

As shown in FIG. 2, when the trigger switch 114 is actuated, the charge signals 1 and 2 are outputted from the microcomputer 151 to transistors Q1 and Q2, respectively. As a result, the charging capacitors C1, C2 are charged with a high voltage (for example, a few hundred volts) of a secondary coil of switching transformers T1, T2 via diodes D1, D2. At this time, the time at which the charge signal 2 is outputted to the transistor Q2 (the time at which the charging capacitor C1 is charged) can be arbitrarily changed within a predetermined range (shown by the arrow in FIG. 4). Thereafter, the ignition signal 1 is impressed from the microcomputer 151 to the trigger element SCR1, and the electric charge charged into the charging capacitor C1 is discharged to the primary side of an ignition coil T3. At this time, a high voltage of a few dozen kilo volts is induced on the secondary side of the ignition coil T3. As a result, a spark is generated at the spark plug 140 ("first discharge"), Subsequently, the ignition signal 2 is outputted from the microcomputer 151 and the trigger element SCR2 is turned on. The electric charge charged into the charging capacitor C1 is then discharged to the primary side of the ignition coil T3. At this time, a high voltage of a few dozen kilo volts is induced on the secondary side of the ignition coil T3 and is continuously sparked from the spark plug 140 ("second discharge"). As a result, the waveform of the second discharge in the ignition circuit unit 210 may be contiguous to the waveform of the first discharge as shown by the solid line in FIG. 4, or it may overlap with the waveform of the first discharge as shown by the broken line in FIG. 5. FIG. 5 shows the waveforms of the first and second discharges having the same peak value and the same discharge time.

The microcomputer 151 controls the power input in each of the ignition circuits 1, 2 independently, so that the power output at the spark plug 140 can be changed. With this construction, reliable ignition can be realized by the spark plug 140 with a reduced number of times of ignition. Specifically, after discharge of the one charging capacitor C1 of the ignition circuit 1, the charging capacitor C2 of the other ignition circuit 2 is discharged without delay. In this manner, sparking of the spark plug 140 can be continuously performed at the time of plug ignition.

FIGS. 6 to 13 are referred to with regard to the nailing control and operation of the nailing machine 101 provided with the ignition control device 150 having the above-described construction. FIGS. 6 to 9 show flow charts with regard to the nailing control of the nailing machine 101 of this embodiment. FIGS. 10 to 13 schematically show the nailing process of the nailing machine 101 of this embodiment. The nailing control shown in the flow charts of FIGS. 6 to 13 is exercised by the microcomputer 151 of the ignition control device 150.

Figure 6:
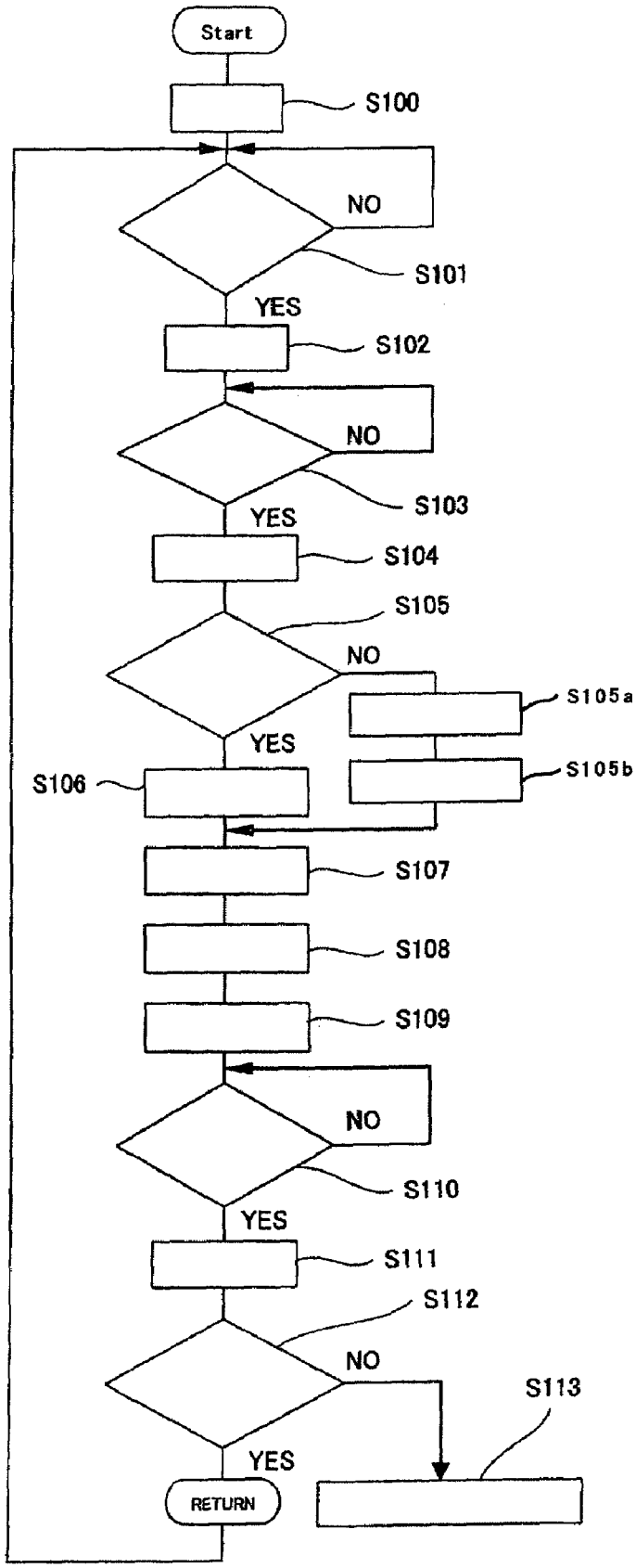
FIG. 6 is a flow chart with regard to the nailing control of the nailing machine 101.

As shown in FIG. 6, in first step S100 of the nailing operation, initial setting is programmed. In the initial setting, a preparatory operation is performed such as attaching the holder 107 to the lower end of the handgrip 105 as shown in FIG. 1. The actual nailing operation is started from the initial state in which the nailing machine 101 is allowed to operate.

Figure 10:
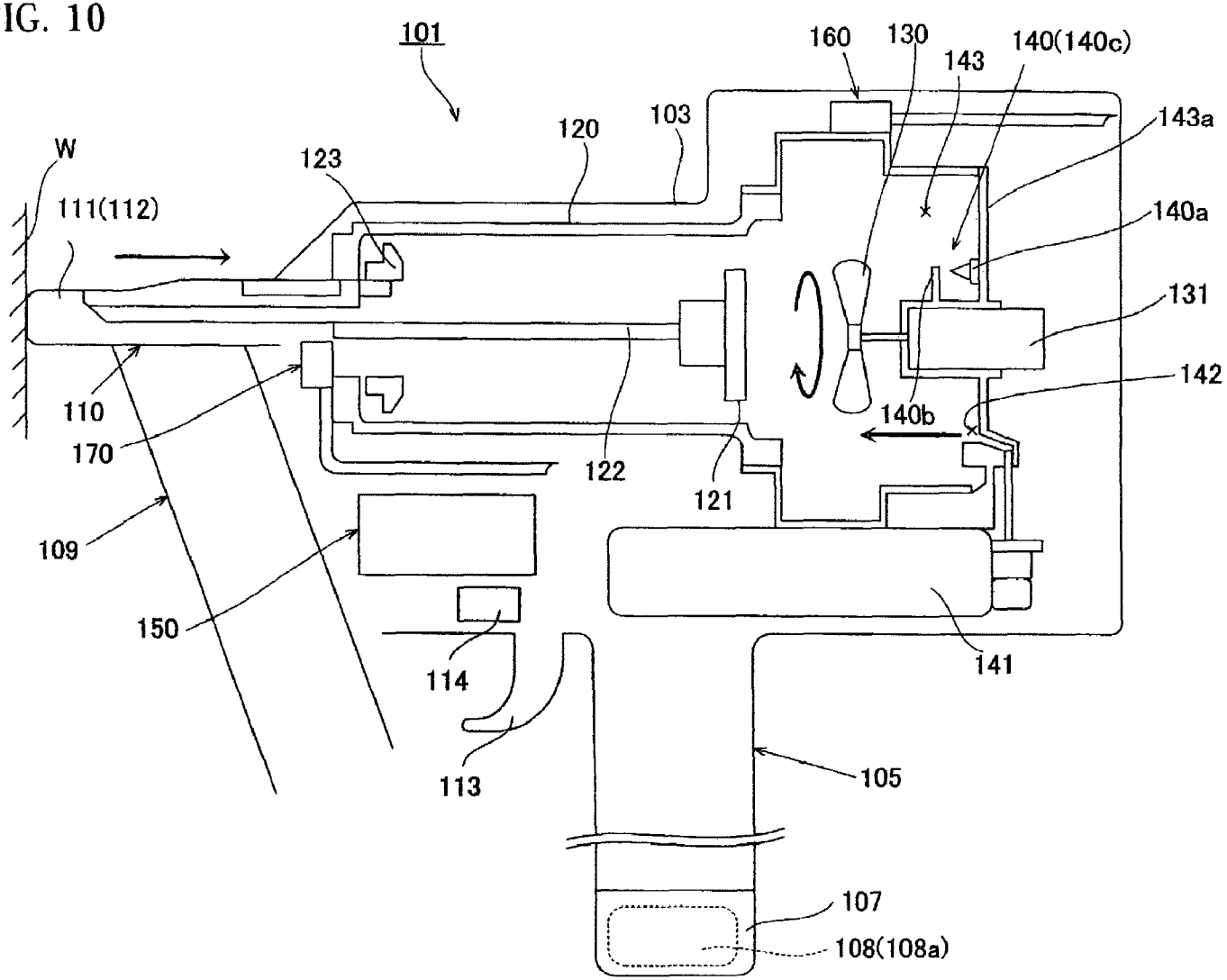
FIG. 10 schematically shows the nailing process of the nailing machine 101.

In step S101 in FIG. 6, it is determined whether the contact arm 111 is pressed against the workpiece W or not. As shown in FIGS. 1 and 10, this can be determined by detection of the contact arm switch 112. When the nailing machine 101 is moved toward the workpiece W and the contact arm 111 is pressed against the workpiece W, the contact arm switch 112 detects the movement of the contact arm 111 in the opposite direction. This step S101 is repeated until it is determined that the contact arm 111 is pressed against the workpiece W (YES in step S101), and go to step S102 when it is determined that the contact arm 111 is pressed against the workpiece W.

Figure 7:
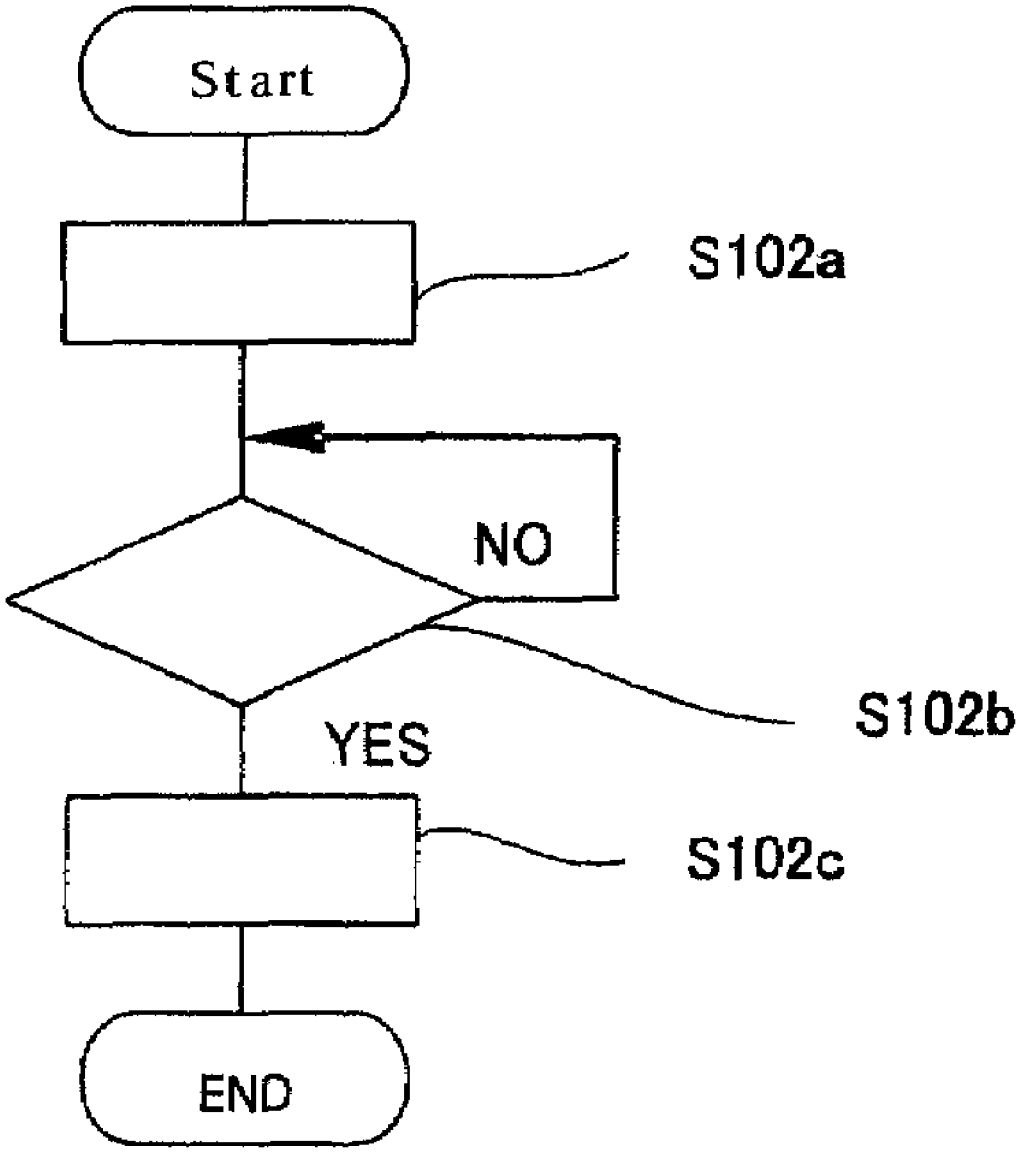
FIG. 7 is a flow chart with regard to the nailing control of the nailing machine 101.

In step S102 in FIG. 6, rotation of the fan 130 is controlled. As shown in FIG. 7 which shows the sequence of this control, in step S102*a*, the motor 131 is driven and the fan 130 starts rotating. Subsequently, when a lapse of a predetermined time period (8 seconds in FIG. 7) is detected by a timer in step S102*b*, the motor 131 is stopped and the fan 130 stops rotating in step S102*c*. Thus, the fan 130 starts rotating in conjunction with the movement of pressing the contact arm 111 against the workpiece W. Similarly, supply of flammable gas from the gas cylinder 141 is also interlocked to the movement of pressing the contact arm 111 against the workpiece W (see FIG. 10).

Figure 11:
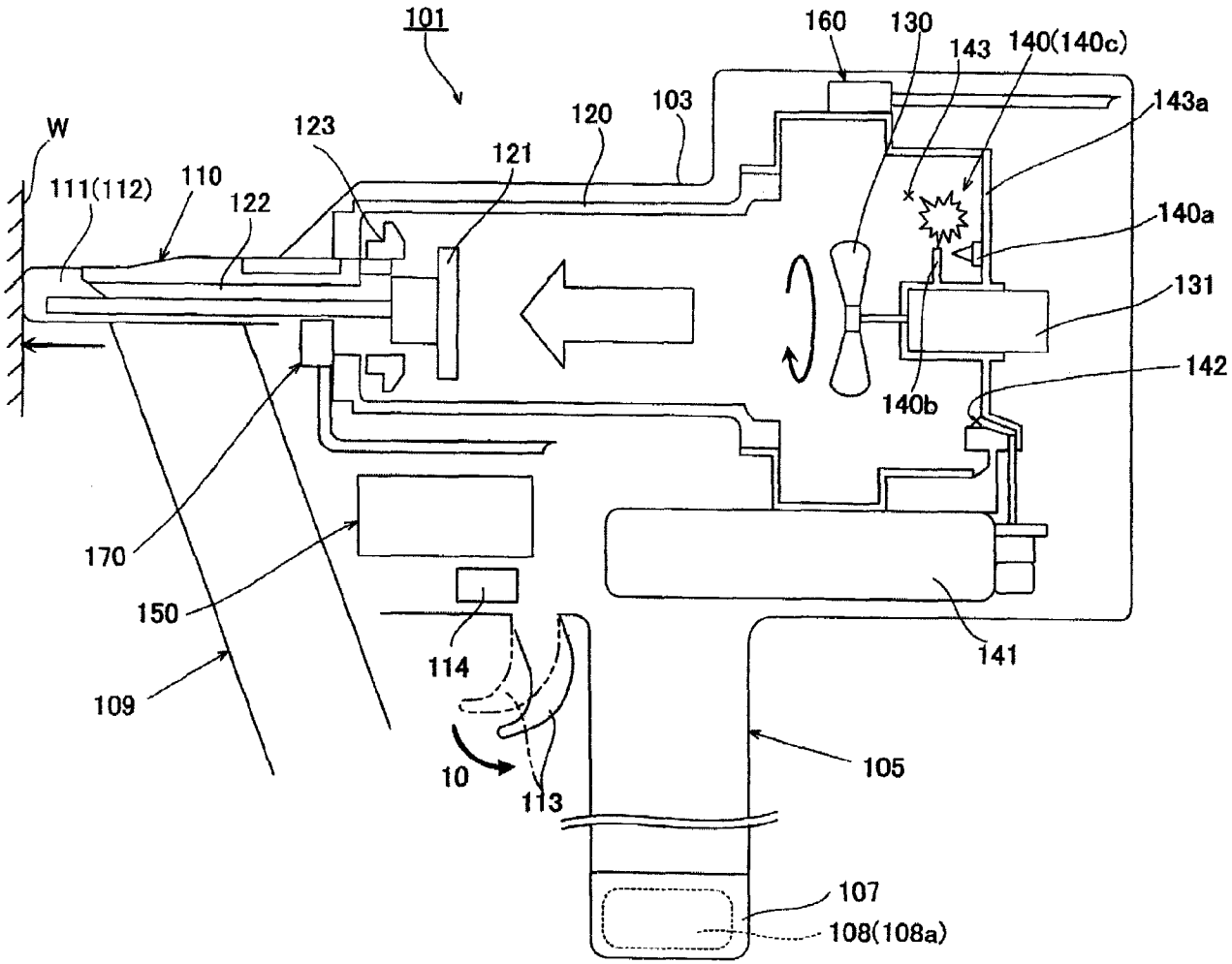
FIG. 11 schematically shows the nailing process of the nailing machine 101.

In step S103 in FIG. 6, it is determined whether a trigger switch (the trigger switch 114 in FIG. 10) is kept on for a certain period of time (during which the fan 130 is rotating). This can be determined by depressing the trigger 113 in the direction of an arrow 10 as shown in FIG. 11 in order to detect the status of the trigger switch 114. This step S103 is repeated until it is determined that the trigger switch 114 is kept on (YES in step S103), and go to step S104 when it is determined that the trigger switch 114 is kept on.

In step S104 in FIG. 6, the battery voltage of the battery 108 in the holder 107 is detected by the voltage detecting circuit 108*a* and read in. Then, in step S105, it is determined whether the read-in battery voltage is equal to or larger than a specified value 1 (for example, 7 volts). If it is determined that the read-in battery voltage is equal to or larger than the specified value 1 (YES in step S105), go to step S106 in which the ignition circuit 1 is turned on.

Otherwise (when NO in step S105) or when the battery voltage is smaller than the specified value 1 (the voltage threshold), it goes to step S105*a* and the charge signal 2 is turned on and then, it goes to step S105*b* and a warning of low battery charge is given. Then, bypass step S106 and go to step S107.

In this embodiment, when the battery voltage is below the predetermined voltage threshold, power is inputted to the spark plug 140 via a smaller number of ignition circuits than the number of the ignition circuits used when it exceeds the voltage threshold, or via only the ignition circuit 2. With this construction, when the battery voltage is relatively low, the number of the ignition circuits to be used is reduced, so that reliable plug ignition of the spark plug 140 can be realized.

Figure 8:
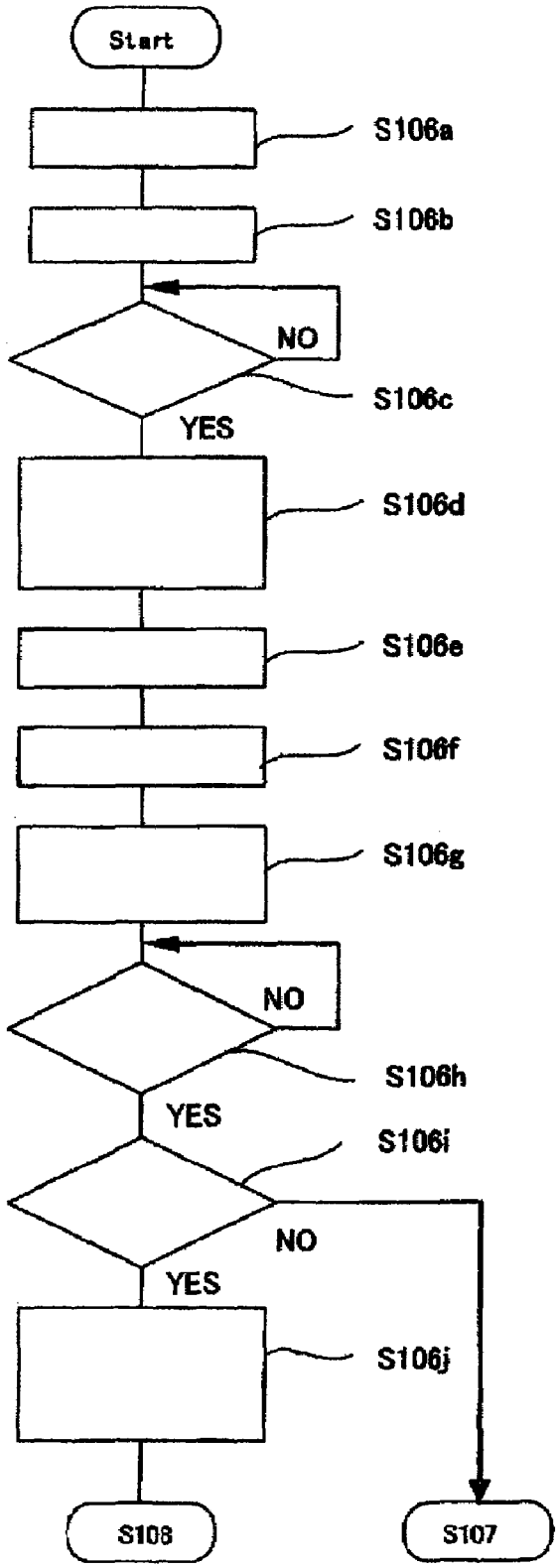
FIG. 8 is a flow chart with regard to the nailing control of the nailing machine 101.

In step S106 in FIG. 6, the ignition circuit 1 is turned on. The sequence of FIG. 8 is referred to with regard to this operation of the ignition circuit 1. Specifically, as shown in FIG. 8, first in step S 106*a*, the charge signal 1 is turned on, and in step S106*b*, the charge signal 2 is turned on. As a result, charging of the charging capacitors C1, C2 is started. Thereafter, in step S106*c*, it is detected by a timer whether a predetermined charging time has elapsed. When the predetermined charging time has elapsed (YES in step S106*c*), it goes to step S106*d* and programs the combustion completion interrupt service. Then, in step S106*e*, the ignition signal 1 is turned on. Thus, the power charged into the charging capacitor C1 is discharged between the electrodes of the spark plug 140 and a first spark is generated at the spark plug 140.

At this time, in step S106*f* in FIG. 8, the current detection circuit 221 detects the spark current at the time of the plug ignition. Specifically, the spark current detected by the current detection circuit 221 at the time of the plug ignition is compared with a predetermined current threshold. When the actual spark current is lower than the current threshold, the warning device 223 can be activated to warn the user of the low spark current or the abnormal condition of the ignition circuit. Further, in step S106*g*, a next power input timing (spark timing) is calculated based on the temperature relating to the combustion chamber 143 which is detected by the temperature detection circuit 140*c*. Specifically, the detected temperature is compared with a predetermined temperature threshold, and when the actual temperature is lower than the temperature threshold, a next power input timing is programmed to be advanced in order to secure a reliable plug ignition. In this manner, the next power input timing (spark timing) is optimized, so that proper combustion of flammable gas can be realized by sparks of the spark plug.

In step S106*h* in FIG. 8, it is detected by a timer whether the predetermined time calculated in step S106*g* has elapsed. When the predetermined time has elapsed (YES in step S106*h*), it goes to step S106*i*. Then, it is further determined whether combustion has been properly completed. This can be determined, as shown in FIG. 11, by the impact sensor 160 and the photoelectric switch 170 which electrically detect the combustion pressure within the combustion chamber 143 and the behavior of the driver 122 or other elements. When it is determined that the combustion has been properly completed (YES in step S106*i*), programming of the combustion completion interrupt service is cancelled in step S106*j*. Then it goes to S108 in FIG. 6.

On the other hand, when it is determined that the combustion has not been properly completed (NO in step S106*i*), it goes to step S107 in FIG. 6. Then the ignition circuit 2 is turned on. By thus controlling, when the combustion within the combustion chamber 143 has not been properly completed, the plug ignition operation of the spark plug 140 is repeated, so that combustion can be more reliably performed within the combustion chamber 143. As a result, a feedback control can be performed in response to the combustion status within the combustion chamber 143. Thus, useless spark energy release and the chance of occurrence of incomplete combustion can be effectively reduced.

Figure 9:
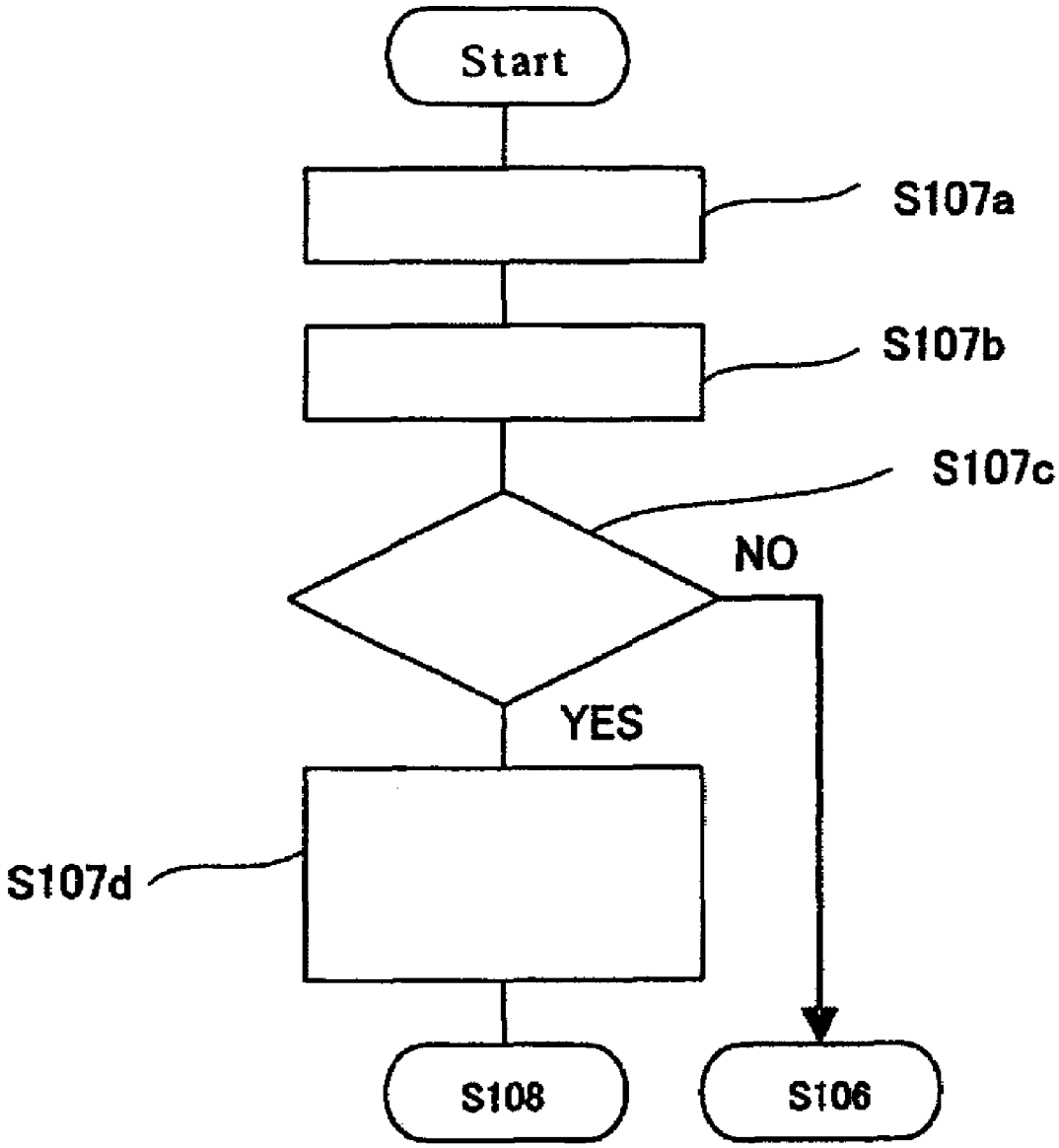
FIG. 9 is a flow chart with regard to the nailing control of the nailing machine 101.

The sequence of FIG. 9 is referred to with regard to the operation of the ignition circuit 2 in step S107 in FIG. 6. Specifically, as shown in FIG. 9, first in step S107*a*, the ignition signal 2 is turned on. Thus, the power charged into the charging capacitor C2 is discharged between the electrodes of the spark plug 140 and a second spark is generated at the spark plug 140.

At this time, in step S107*b* in FIG. 9, the current detection circuit 221 detects the spark current at the time of the plug ignition. Further, in step S107*c*, it is determined whether combustion has been properly completed. As shown in FIG. 11, this can be determined by the impact sensor 160 and the photoelectric switch 170 which electrically detect the combustion pressure within the combustion chamber 143 and the behavior of the driver 122 or other elements. When it is determined that the combustion has been properly completed (YES in step S107*c*), programming of the combustion completion interrupt service is cancelled in step S107*d*. Then it goes to S108 in FIG. 6.

On the other hand, when it is determined that the combustion has not been properly completed (NO in step S107*c*), it goes back to step S106 in FIG. 6. Then the ignition circuit 1 is turned on again. By thus controlling, when the combustion within the combustion chamber 143 has not been properly completed, the plug ignition operation of the spark plug 140 is repeated, so that combustion can be more reliably performed within the combustion chamber 143. As a result, a feedback control can be performed in response to the combustion status within the combustion chamber 143. Thus, useless spark energy release and the chance of occurrence of incomplete combustion can be effectively reduced.

Figure 12:
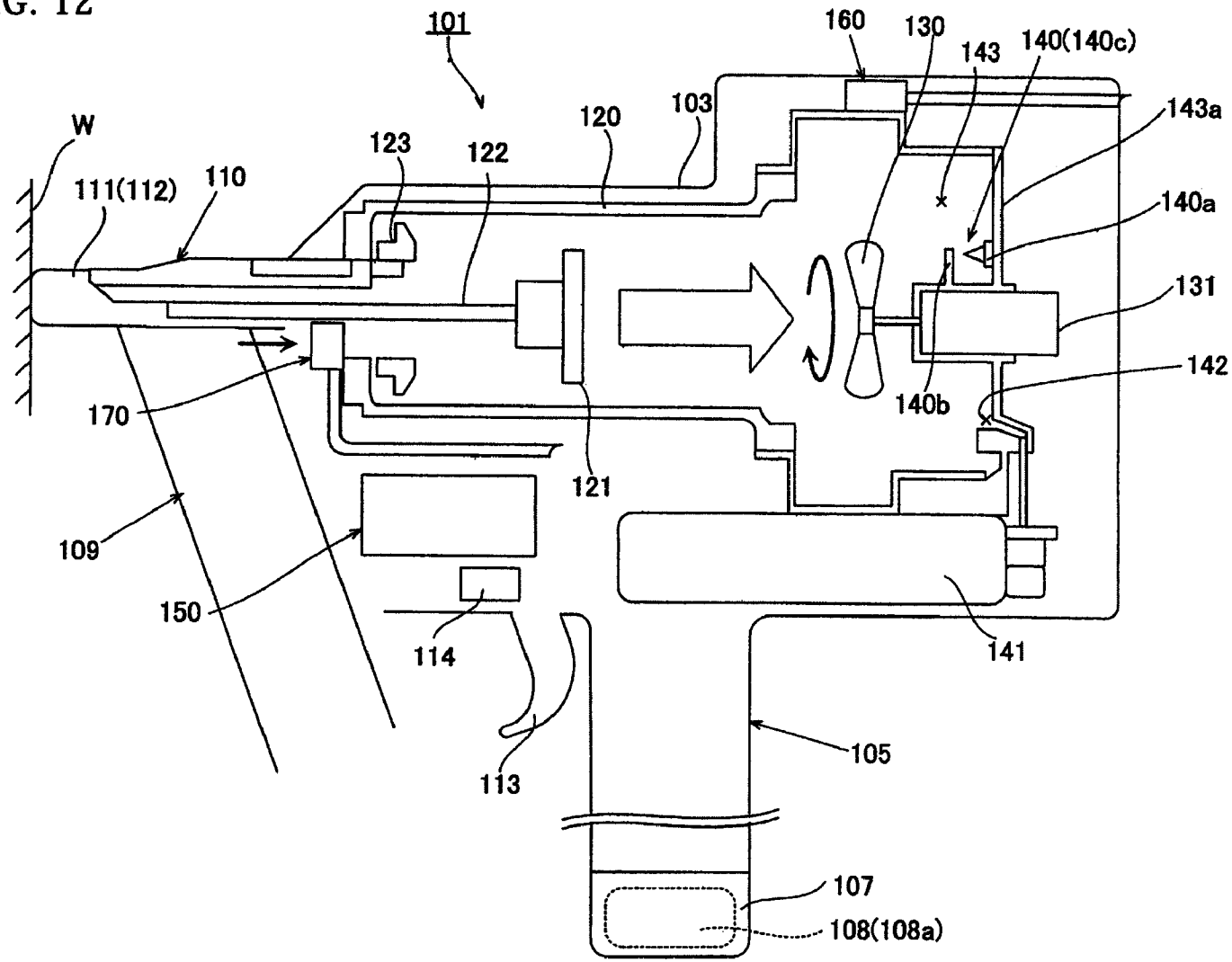
FIG. 12 schematically shows the nailing process of the nailing machine 101.

At the time of this plug ignition of the spark plug 140, as shown in FIG. 11, the mixture of flammable gas and air is burned within the combustion chamber 143 with an exhaust port being closed. The exhaust port is defined by a clearance created between the combustion chamber wall 143*a* and the cylinder 120 in FIG. 1. As a result, the inside of the combustion chamber 143 expands by combustion. At this time, the piston 121 slides toward the tool tip end within the cylinder 120 by combustion pressure generated by combustion. Thus, the operation of driving nails into the workpiece W is performed via the driver 122 moving toward the tool tip end. After the driving operation of the driver 122, as shown in FIG. 12, the driver 122 returns to the rear side of the tool, and the inside of the combustion chamber 143 is cooled and contracted.

Figure 13:
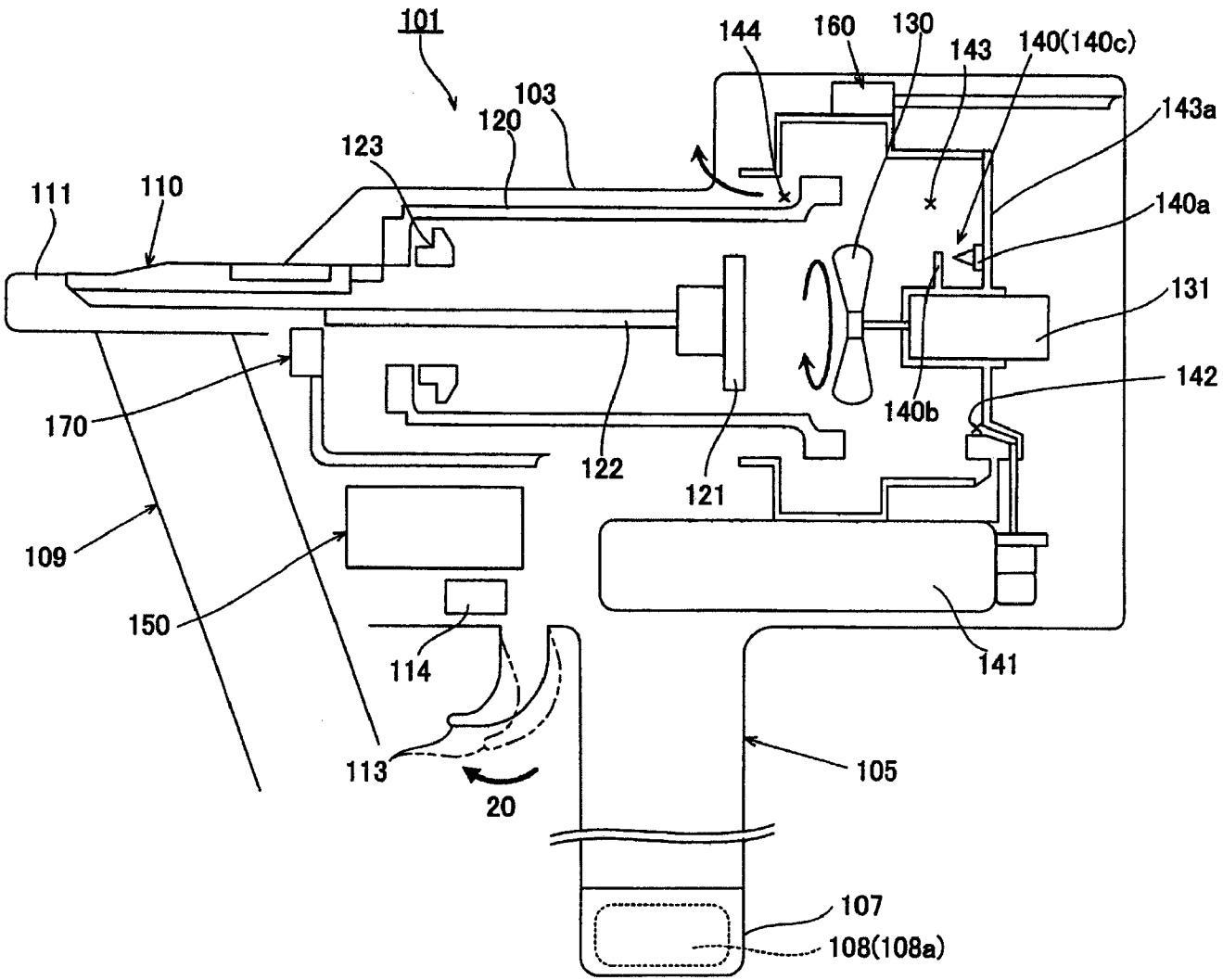
FIG. 13 schematically shows the nailing process of the nailing machine 101.

Thereafter, when the contact arm 111 is disengaged from the workpiece and the trigger 113 is released, the ignition circuit 1 is turned off in step S108 in FIG. 6, and the ignition circuit 2 is turned off in step S109. Then, it goes to step S110. At this time, as shown in FIG. 13, the trigger 113 is released in the direction of an arrow 20. Further, the contact arm 111 is disengaged from the workpiece W. The combustion gas which has been burned in the combustion chamber 143 is discharged to the outside of the combustion chamber 143 through the exhaust port 144 created between the combustion chamber wall 143*a* and the cylinder 120.

In step S10 in FIG. 6, the contact arm 111 is disengaged from the workpiece W, and the contact arm switch 112 is turned off. Further, it is determined whether the trigger 113 has been released and the trigger switch 114 has been turned off. When it is determined that such release has been made (YES in step S110), in step S111, the battery voltage is detected by the voltage detection circuit 108*a* and read in. In step S112, it is determined whether the read-in battery voltage is equal to or larger than a specified value 2 (for example, 5.9 volts). If it is determined that the read-in battery voltage is equal to or larger than the specified value 2 (YES in step S112), return to step S101. Otherwise (when NO in step S112) or when the battery voltage is smaller than the specified value 2, in step S113, power supply from the battery 108 is forcibly cancelled in order to disable the driving operation. At the same time, an indication for battery replacement is given.

Other Representative Embodiments

The present invention is not limited to the above embodiment, but rather, may be added to, changed, replaced with alternatives or otherwise modified. For example, the following provisions can be made in application of this embodiment.

In the above embodiment, the ignition circuit units 210, 220 is described as being formed by using the capacitor-type ignition circuits 1, 2. However, in this invention, in addition to or as an alternative to the capacitor-type ignition circuits, a transistor-type ignition circuit may be used. Further, in this invention, two or more of the ignition circuits of the same type or of different types may be used in combination to form the ignition circuit unit.

Figure 14:
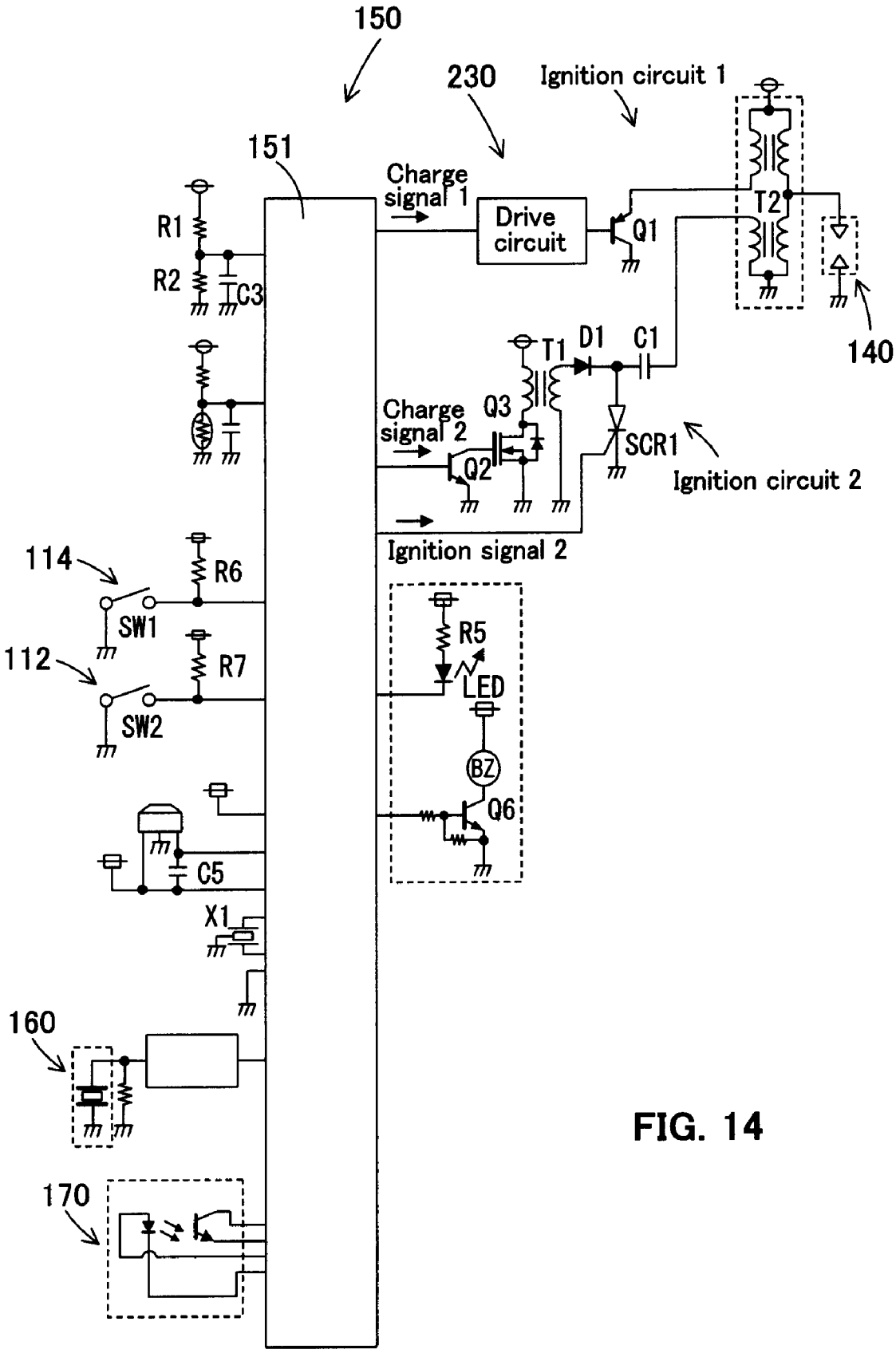
FIG. 14 is a schematic diagram showing another embodiment of an ignition circuit unit 230 in the ignition control device 150.

FIG. 14 is a schematic diagram showing another embodiment of an ignition circuit unit 230 in the ignition control device 150 of this embodiment.

As shown in FIG. 14, the ignition circuit unit 230 features the construction in which the capacitor-type ignition circuit 2, which is similar to those used in the above-described ignition circuit units 210, 220, is used in combination with a different type or transistor-type ignition circuit 1. The transistor-type ignition circuit 1 and the capacitor-type ignition circuit 2 here correspond to the "plurality of ignition circuits" according to this invention. In the ignition circuit unit 230, a drive circuit of the ignition circuit 1 is disposed on the primary side of the ignition coil and outputs a signal to the transistor Q1 based on the charge signal 1 from the microcomputer 151. Further, charge in the charging capacitor C1 of the ignition circuit 2 which is disposed on the primary side of the ignition coil is executed based on the charge signal 2 from the microcomputer 151, and discharge in the charged charging capacitor C1 is executed based on the ignition signal 2 from the microcomputer 151. Thus, the output timing of the charge signal 1 to the transistor Q1 and the timing of charge and discharge in the charging capacitor C1 can be individually controlled by the microcomputer 151.

Figure 15:
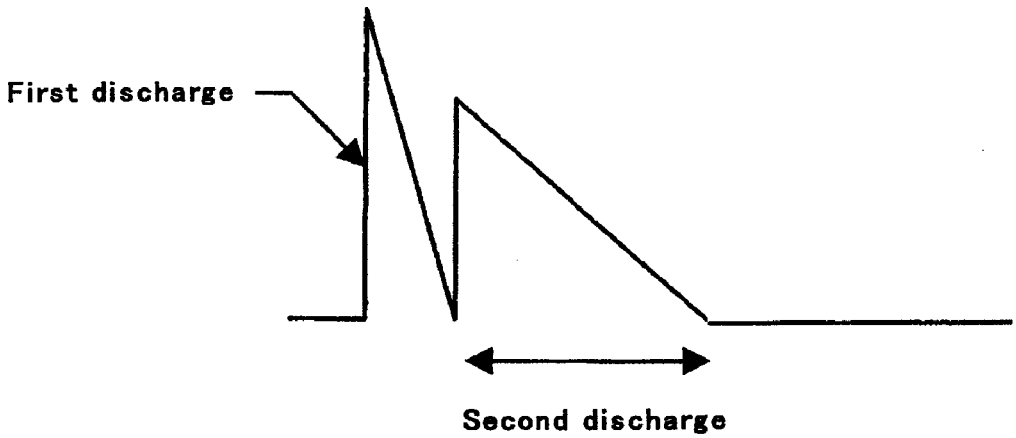
FIG. 15 shows a discharge waveform in the ignition circuit unit 230.
Figure 16:
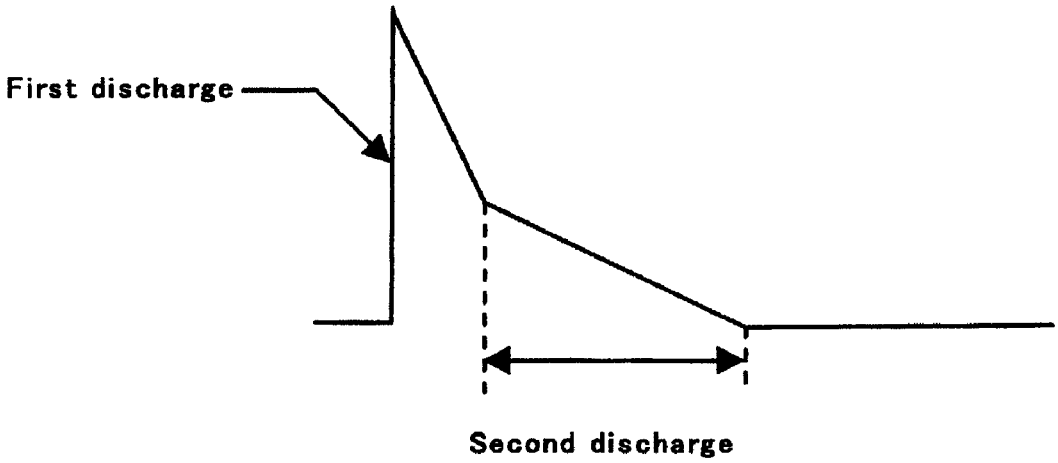
FIG. 16 shows a discharge waveform in the ignition circuit unit 230.

FIGS. 15 and 16 show a discharge waveform in the ignition circuit unit 230. The waveform of the second discharge in the ignition circuit unit 230 may be contiguous to the waveform of the first discharge as shown by the solid line in FIG. 15, or it may overlap with the waveform of the first discharge as shown by the solid line in FIG. 16. Further, in FIGS. 15 and 16, the waveform of the second discharge is shown having a lower peak value and a longer discharge time than the waveform of the first discharge. As in the case of the ignition circuit units 210 and 220, more reliable ignition by the spark plug 140 can be realized by using the ignition circuit unit 230. Specifically, after power output by the ignition circuit 1, the charging capacitor C2 of the other ignition circuit 2 is discharged without delay. In this manner, sparking of the spark plug 140 can be continuously performed at the time of plug ignition. Further, different ignition waveforms (discharge waveforms) can be generated by using different ignition systems. As a result, reliable ignition can be realized with a reduced number of times of ignition.

Further, with regard to the input manner of power to be inputted to the spark plug 140 in each of the ignition circuits 1 and 2, the time, timing, intensity and other factors of power input in each of the ignition circuits as well as the number of ignition circuits which contribute to power input can be appropriately selected. As a result, the power to be outputted at the spark plug 140 is appropriately changed in output time (spark time), output timing (spark timing), output intensity (spark intensity) or other factors. Specifically, the number of the ignition circuits to be used, the discharge timing (spark timing) in each of the ignition circuits, the discharge waveform in each of the ignition circuits, or other factors can be changed based on the results of detection, for example, of the battery voltage, temperature relating to the combustion chamber, and the spark current at the time of plug ignition. Thus, power input in each of the ignition circuits can be controlled. The manner of changing the number of ignition circuits to be used is included in the control of the "manner of power input in each of the ignition circuits" according to this invention. For example, it can be programmed such that only one of the plurality of the ignition circuits is used when a low battery voltage or a low spark current is detected.

Further, in the above-described embodiment, the ignition control device 150 is described as executing four processes, i.e. a process (first process) of minimizing the number of the ignition circuits to be used, based on the detection result of the battery voltage of the battery 108, a process (second process) of calculating a next power input timing based on the detection result of the temperature relating to the combustion chamber 143, a process (third process) of detecting any abnormal condition based on the detection result of the spark current at the time of plug ignition, and a process (fourth process) of determining completion of combustion based on pressure information relating to the combustion pressure within the combustion chamber 143 and positional information relating to the actuated position of the driver 122, and repeating sparking. However, in this invention, an ignition control device which can execute at least one of the four processes can be applied.

Further, in the above embodiment, the nailing machine is described as a representative example of the combustion power tool. This invention can also be applied to other combustion power tools, such as a tacker which is used for driving staples in.

DESCRIPTION OF NUMERALS

101 nailing machine
103 housing
105 handgrip
107 holder
108 battery
108*a* voltage detection circuit
109 magazine
110 nail ejection part
111 contact arm
112 contact arm switch
113 trigger
114 trigger switch
120 cylinder
121 piston
122 driver
123 cushion rubber
130 fan
131 motor
140 spark plug
140*a*, 140*b* electrode
141 gas cylinder
142 jet
143 combustion chamber
143*a* combustion chamber wall
140*c* temperature detection circuit
144 exhaust port
150 ignition control device
151 microcomputer
160 impact sensor
170 photoelectric switch
210, 220, 230 ignition circuit unit
221, 222 current detection circuit
223 warning device

I claim:

1. A combustion power tool comprising:

a combustion chamber, a gas supply section that supplies flammable gas into the combustion chamber, a single spark plug that is disposed within the combustion chamber and outputs electric power supplied from a power supply to burn the flammable gas within the combustion chamber, an ignition control device that controls power to be outputted at the single spark plug, a cylinder connected to the combustion chamber, a piston member that is disposed within the cylinder to slide within the cylinder by combustion pressure which is generated by combustion of the flammable gas in the combustion chamber and a tool member that is actuated by sliding movement of the piston member to apply an impact force to a workpiece so as to perform a predetermined operation, wherein the ignition control device includes a plurality of ignition circuits that are connected to the single spark plug and can independently input power to the spark plug, and a control section that controls the manner of power input in each of the ignition circuits.

2. The combustion power tool as defined in claim 1, wherein the control section changes the manner of power output by controlling the manner of power input in each of the ignition circuits.

3. The combustion power tool as defined in claim 1, further comprising a voltage detecting section to detect voltage of the power supply, wherein, when the detected voltage is below a predetermined voltage threshold, the control section inputs power to the single spark plug via a smaller number of ignition circuits than when the detected voltage exceeds the voltage threshold.

4. The combustion power tool as defined in claim 1, further comprising a temperature detecting section to detect temperature relating to the combustion chamber, wherein the control section determines a next power input timing in each of the ignition circuits based on the temperature relating to the combustion chamber which is detected by the temperature detecting section.

5. The combustion power tool as defined in claim 1, further comprising a current detecting section to detect spark current at the time of plug ignition of the single spark plug, and a warning output section to output a warning to a user, wherein the control section transmits a warning output signal to the warning output section when the detected spark current is below a predetermined current threshold.

6. The combustion power tool as defined in claim 1, further comprising an information detecting section to detect at least one of pressure information relating to the combustion pressure within the combustion chamber and positional information relating to the actuated position of the tool member, wherein the control section determines completion of combustion within the combustion chamber based on the information detected by the information detecting section.

7. The combustion power tool as defined in claim 1, wherein the plurality of the ignition circuits comprise at least two capacitor-type ignition circuits.

8. The combustion power tool as defined in claim 1, wherein the plurality of the ignition circuits comprise at least two transistor-type ignition circuits.

9. The combustion power tool as defined in claim 1, wherein the plurality of the ignition circuits comprise a capacitor-type ignition circuit and a transistor-type ignition circuit.

10. The combustion power tool as defined in claim 1 defied as a nailing machine or a tacker to drive staples into the workpiece.

* * * * *